US009284678B2

(12) United States Patent
Hanau et al.

(10) Patent No.: US 9,284,678 B2
(45) Date of Patent: Mar. 15, 2016

(54) METHOD FOR PROCESSING LAUNDRY, AND LAUNDRY TREATMENT DEVICE SUITABLE FOR CARRYING OUT THE METHOD

(75) Inventors: Andreas Hanau, Berlin (DE); Hartmut Schaub, Brieselang (DE); Ingo Schulze, Panketal (DE)

(73) Assignee: BSH Hausgeräte GmbH, Munich (DE)

( * ) Notice: Subject to any disclaimer, the term of this patent is extended or adjusted under 35 U.S.C. 154(b) by 1057 days.

(21) Appl. No.: 13/063,223

(22) PCT Filed: Aug. 28, 2009

(86) PCT No.: PCT/EP2009/061135
§ 371 (c)(1),
(2), (4) Date: Mar. 10, 2011

(87) PCT Pub. No.: WO2010/031675
PCT Pub. Date: Mar. 25, 2010

(65) Prior Publication Data

US 2011/0162152 A1 Jul. 7, 2011

(30) Foreign Application Priority Data

Sep. 22, 2008 (DE) ..... 10 2008 042 264

(51) Int. Cl.
*D06F 39/02* (2006.01)
*D06F 39/08* (2006.01)
*D06F 58/20* (2006.01)

(52) U.S. Cl.
CPC ..... *D06F 58/203* (2013.01); *D06F 39/02* (2013.01); *D06F 39/022* (2013.01); *D06F 39/028* (2013.01); *D06F 39/08* (2013.01); *D06F 39/083* (2013.01)

(58) Field of Classification Search
CPC ..... D06F 58/203
See application file for complete search history.

(56) References Cited

U.S. PATENT DOCUMENTS 3,762,866 A * 10/1973 Rayment et al. ..... 8/149.1
5,917,118 A * 6/1999 Kosann et al. ..... 8/149.1
6,241,782 B1 * 6/2001 Vande Haar ..... 8/159

(Continued)

FOREIGN PATENT DOCUMENTS

CN 1125275 6/1996
CN 1888224 1/2007

(Continued)

OTHER PUBLICATIONS

Machine translation of DE 102006003416 A1 to Schulze, no date.*

(Continued)

*Primary Examiner* — Michael Barr
*Assistant Examiner* — Levon J Shahinian
(74) *Attorney, Agent, or Firm* — Nixon & Vanderhye P.C.

(57) ABSTRACT

A method for applying a processing composition to laundry in a laundry treatment appliance with a rotatably mounted drum is provided. The method includes setting a predefined residual moisture content in the laundry by adding water and by rotating the drum. The method further includes applying a processing composition to the laundry in liquid form or in the form of fine droplets. The processing composition is sprayed onto the laundry by an introduction apparatus while the drum is moved at a speed at which the laundry lies against the drum or at a faster speed.

17 Claims, 3 Drawing Sheets

(56) References Cited

U.S. PATENT DOCUMENTS

| | | | | |
|---|---|---|---|---|
| 6,609,311 | B2 | 8/2003 | Hagemann et al. | |
| 7,047,666 | B2 | 5/2006 | Hahn et al. | |
| 8,196,439 | B2 | 6/2012 | Bae et al. | |
| 2003/0140427 | A1* | 7/2003 | Yamamoto et al. | 8/159 |
| 2004/0129032 | A1* | 7/2004 | Severns et al. | 68/5 C |
| 2005/0022319 | A1* | 2/2005 | Kim et al. | 8/159 |
| 2005/0262644 | A1 | 12/2005 | Oak et al. | |
| 2005/0262645 | A1 | 12/2005 | Yang et al. | |
| 2007/0151048 | A1* | 7/2007 | Palacin et al. | 8/602 |
| 2007/0283508 | A1* | 12/2007 | Wong et al. | 8/149.3 |
| 2008/0155756 | A1 | 7/2008 | Ogden et al. | |
| 2008/0248704 | A1 | 10/2008 | Mathis et al. | |
| 2008/0276661 | A1 | 11/2008 | Bae et al. | |
| 2008/0276964 | A1* | 11/2008 | Hendrickson et al. | 134/18 |
| 2011/0162152 | A1 | 7/2011 | Hanau | |

FOREIGN PATENT DOCUMENTS

| | | | |
|---|---|---|---|
| DE | 10036850 | A1 | 10/2001 |
| DE | 102005046163 | A1 | 3/2007 |
| DE | 102006003416 | A1 | 7/2007 |
| DE | 102008021853 | | 11/2008 |
| EP | 0676497 | B1 | 9/1999 |
| EP | 1983086 | A2 | 10/2008 |
| EP | 2042645 | A1 | 4/2009 |
| WO | 03023122 | A1 | 3/2003 |

OTHER PUBLICATIONS

International Search Report issued in PCT/EP2010/057419.
National Search Report issued in DE 10 2009 026 773.5.
Chinese Office Action including Search Report and English Translation for corresponding Chinese Application No. 201080024290.3 mailed Aug. 5, 2013, 8 pages.

* cited by examiner

METHOD FOR PROCESSING LAUNDRY, AND LAUNDRY TREATMENT DEVICE SUITABLE FOR CARRYING OUT THE METHOD

This application is a U.S. National Phase of International Application No. PCT/EP2009/061135, filed Aug. 28, 2009, which designates the U.S. and claims priority to German Application No. 102008042264.9, filed Sep. 22, 2008, the entire contents of each are hereby incorporated by reference.

BACKGROUND OF THE INVENTION

The invention relates to a method for processing laundry and a laundry treatment appliance that is particularly suitable for carrying out said method.

It is known that laundry can be impregnated, for example with fragrances, in a laundry treatment appliance. Industrial processing methods generally operate using the batch method or foulard method. With the foulard method panels of material are brought into contact with the processing composition to be applied in each instance in a larger quantity of treatment solution. The degree of extraction, defined as the percentage of the active agent deposited on the laundry is largely a function of the affinity of the active agent to the fiber but is generally low.

Methods and apparatuses for processing laundry with fragrances or similar have already been developed for laundry treatment appliances, in particular for tumble dryers.

DE 601 19 356 T2 discloses an apparatus for treating fabrics in a drum-type dryer. Cyclodextrins are specified as agents for neutralizing odors and as perfume enhancers. These and numerous other substances are used according to the doctrine of DE 601 19 356 T2 for fabric conditioning and are enclosed to this end in a membrane, which prevents the egress of liquids but not the egress of gases. During the operation of a dryer the action of heat causes liquid to evaporate and escape from the membrane casing and thus be distributed in the dryer and the laundry therein. The disadvantages of this type of laundry processing are that no large volumes of processing substances reach the laundry and not all processing substances are suitable for evaporation. Microcapsules and cyclodextrins for example should be distributed as a liquid.

DE 10 2005 046 163 A1 discloses a method and facility, in particular a tumble dryer, in which in addition to the laundry items to be treated a further textile item is used as a filter, serving to absorb the vapors and substances coming out of the other laundry items. Such a dryer or washer-dryer is not suitable for processing the textile items therein.

DE 100 36 850 A1 discloses an apparatus for discharging a liquid product into the interior of a dishwasher or washing machine, in particular a mechanical spray facility with a storage container and a nozzle, which is suitable for spraying liquids. No compressed gas atomizer is used with this apparatus; instead the container is compressed mechanically and the liquid is driven through the nozzle and atomized. Such an atomizer produces an aerosol, which forms very large drops that can cause stains to form on laundry items.

EP 1 431 443 A1 discloses a tumble dryer, which is fitted with an ultrasonic atomizer, which is to be used to introduce substances, for example fragrances, into the drum. An ultrasonic atomizer can produce very fine aerosols but is relatively unsuitable for distributing microdispersed fluids, for example a microcapsule suspension, in a space. It is also not suitable for discharging larger quantities of liquid in as short a time as possible.

EP 0 676 497 A describes a method for spraying perfumed oil onto laundry by means of a compressed spray nozzle, in which the fragrance is sprayed onto already dry laundry, while the drum rotates continuously to distribute the fragrance evenly. Also disclosed is a spray facility, which is positioned in the loading lid of the dryer. This method has the disadvantage that the laundry tumbles around as the drum moves and is sprayed in an uneven manner with the fragrance, which can result in staining.

WO 03/023122 A1 also discloses methods for processing textiles with processing substances by spraying in a drum while said drum rotates at a speed below a speed at which the laundry lies against the drum.

DE 10 2006 003 416 A1 discloses a laundry treatment machine with a facility for deodorizing clothes. To this end a component with a spray nozzle is provided in the seal of the laundry drum and is able to discharge an active agent (e.g. cyclodextrins) in the form of a spray mist into the interior of the drum. The drum should be moved during spraying in such a manner that it is ensured that the laundry present in the drum drops down.

Essentially immersion methods and spray methods are thus known for textile processing (processing of laundry). With the immersion methods various types of textile processing are already used in washing machines, for example for fabric conditioning, impregnation, starching, for the application of ironing aids and so on. As mentioned above, the relatively low degree of extraction is disadvantageous with said methods, as it means that a large proportion of the processing composition used ends up in the waste water unused, which is not only uneconomical but also an environmental burden. The spray methods have the disadvantage that only a very uneven distribution of the processing composition on laundry in a drum results, particularly in the case of a larger load. This means that the intended quantity and distribution of processing composition (processing quality) is only achieved when the drum is not very full.

BRIEF SUMMARY OF THE INVENTION

The object of the present invention is therefore to provide a method for processing laundry and a laundry treatment appliance that is suitable for carrying out said method, in which such disadvantages of the prior art are reduced.

According to the invention this object is achieved by a method and a laundry treatment appliance according to the independent claims. Preferred embodiments of the invention are set out in the respectively dependent claims. Preferred embodiments of the method correspond to preferred embodiments of the laundry treatment appliance, even if specific reference is not made to this herein.

The present invention therefore relates to a method for applying a processing composition to laundry in a laundry treatment appliance having a drum which is mounted in a rotatable manner, wherein (a) a predefined residual moisture content is achieved in the laundry by the addition of water and a first rotation of the drum; and (b) a processing composition is applied to the laundry.

The term "laundry" used here refers to one or more laundry items and comprises textiles, in particular linens, as well as generally all objects that can be treated in a conventional laundry treatment appliance, in particular a conventional washing machine, for example table linen, bed linen, covers, curtains and the like. It is possible to process not only textiles but also composite materials, such as leather goods and other objects made of different materials such as fabric and leather.

Therefore all materials that can be processed with the processing substances described herein according to the inventive method are suitable.

The laundry preferably comprises finished clothing, in particular ready-made clothing. Items of clothing worn close to the body for example are particularly suited to the inventive method, for example if they are to be processed with skin care products.

In one preferred embodiment of the inventive method water is added in a rinse step and the first rotation of the drum takes place as the water is being pumped away or after the water has been pumped away.

The addition of water in step (a) preferably follows immediately after a wash phase, in which the laundry is generally cleaned with the aid of detergents. A rinse phase with water generally follows immediately after such a wash phase, the rinse phase consisting of several, generally two to three, rinse steps.

According to the invention it is preferable for step (a) to correspond to a last rinse step.

According to the invention it is preferable for the predefined residual moisture content in step (a) to be achieved by a first rotation of the drum at a speed at which the laundry lies against the drum. This is the system-based speed at which the laundry items present in a drum lie against the drum casing due to centrifugal forces. In the case of laundry drums with a diameter of approx. 470 mm this is around 70 revolutions per minute (70 rpm).

With the inventive method it is advantageous if the first rotation of the drum in step (a) is performed at a speed $U_1$ of ≥100 rpm. The speed $U_1$ is particularly preferably from 100 to 150 rpm, or at least 230 rpm.

In one preferred embodiment of the inventive method (c) the processing composition is distributed in the laundry by a second rotation of the drum.

The second rotation of the drum in step (c) is preferably performed here at a speed $U_2$ of ≥100 rpm.

The first rotation can be separated from the second rotation by more or less long time interval. For example after the first rotation (a) the drum can be stopped and the processing composition can be applied first to the laundry with the resulting residual moisture content. In a preferred embodiment the second rotation in step (c) can then produce better distribution of the processing composition over the laundry.

According to the invention it is also possible for the addition of the processing composition to overlap in time with the first rotation and/or the second rotation of the drum. Also the speed of the drum during the first rotation and the speed of the drum during the second rotation can be identical or different.

According to the invention however it is preferable for the first rotation and second rotation of the drum to be distinct. This can be achieved for example by inserting a pause between the first rotation and the second rotation, during which the drum stands still and/or by making the speeds during the first and second rotations different. Similarly the speed during the first and/or during the second rotation of the drum can be varied continuously or by setting predefined speed stages.

The processing composition can in principle be used in solid or liquid form. According to the invention however it is preferred that the processing composition is applied to the laundry in liquid form or in the form of fine droplets (spray). The processing composition here can be applied for example by spraying, injection, flushing in or insertion, in some instances after a defined program break. The processing composition is preferably applied to the laundry by spraying by means of a suitable introduction apparatus, while the drum is moved at the speed at which the items lie against it or faster. For spraying purposes the introduction apparatus is provided in an appropriate manner with a nozzle, so that it functions as an atomizer.

It is quite particularly preferable if during the application of the processing composition to the laundry in step (b) the drum is moved in a first substep (c1) at a minimum of the speed at which the laundry lies against the drum and in a second substep (c2) at a speed below the speed at which the laundry lies against the drum in a reverse mode with the processing composition only being discharged by the introduction apparatus when the drum is moved at the speed at which the laundry lies against the drum or faster.

The term "process" within the meaning of the invention refers to a procedure in which the laundry is coated with the processing substances present in the processing composition. The processing substances here are preferably bonded firmly to the surface of the laundry, particularly preferably covalently. Introduction between the fibers is for example also possible. Processing according to the inventive method should preferably also result in the processing substances not being removed from the fabric during normal use of the processed laundry, i.e. generally when the clothing is worn, to any greater degree than is the case with industrially processed textiles. In the case of the microcapsules adhering to the laundry however provision is made for intentional destruction to release the contents.

According to the invention the type of processing composition to be applied is not restricted. The term "processing composition" used here therefore also covers fabric conditioners. According to the invention therefore fabric conditioners may for example only be flushed directly in onto the laundry during the second rotation, for example by way of the seal. This reduces the quantity of fabric conditioner required to a fraction of the quantity necessary at present.

The processing composition is preferably a liquid, in other words a solution or suspension and can comprise various processing substances, for example fragrances, functionalizing substances, preferably cyclodextrins and/or microcapsules. However conventional processing substances can also be used.

In addition to impregnation means, dyes, starches and the like, the processing substances required in the field of sport, wellness and lifestyle with the ever increasing functionality of clothing can also be employed. Examples of the processing substances to be used in the inventive processing composition or to consist of such are specifically cyclodextrins and microcapsules.

The processing composition preferably used according to the invention comprises cyclodextrins and/or microcapsules and optionally further active agents. Such active agents can be selected from substances to be loaded into the microcapsules or cyclodextrins. Examples of these are in particular fragrances, cosmetics, body-care products, e.g. aloe vera, anticellulite substances, and the like. It has proven surprisingly to be possible to process laundry with microcapsules and/or cyclodextrins not only in an industrial process but also in a household washing machine and/or washer-dryer.

Cyclodextrins are cyclic oligosaccharide compounds having a toroidal structure with a central hollow, in which apolar organic compounds can be enclosed. This feature allows them to be used currently in air freshener sprays for example. The cyclodextrin derivatives contained in such products bind the compounds causing unpleasant odors. They also serve as fragrance carriers at the same time.

Microcapsules (also referred to as nanocapsules and microspheres) are generally essentially spherical forms featuring a casing and an interior, generally with a diameter in a range from nanometers to <1 mm. Substances can be enclosed in this interior.

The microcapsules have a casing, made for example of a film-type polymer, in which finely dispersed liquid or solid phases can be enclosed. The casing material can comprise many different types of chemical compound, e.g. gelatin, gum Arabic, agar agar, lactose, microcrystalline cellulose, modified starch, fatty acid esters, phospholipids, chitosan, alginates and collagen, as well as synthetic polymers such as polyacrylates, polyamides, polyvinyl alcohol or polyvinylpyrrolidone.

Fibers and textile surface forms processed with mixtures of hydrophobic active agents and film-type polymers (i.e. microcapsules) are described in DE 10 2004 037 752 A1. Known microcapsules for the textile field include for example what are known as PCM (phase change materials), which act in a heat-regulating manner.

There are textiles already processed with cyclodextrin derivatives or microcapsules, such as outer garments and pantyhose but the processing substances, for example microcapsules, are gradually destroyed or removed during wear and during a normal cleaning process, for example in a washing machine. The processing effect is therefore gradually lost. In the case of microcapsules this destruction may be intentional, allowing the microcapsules to release their contents. However the user of the originally processed materials has not been able, until now, to reprocess them for a number of wear cycles.

Processing with cyclodextrins is preferred in particular for laundry made of cotton materials. Different materials can be used for processing with microcapsules.

The object of the invention is also a laundry treatment appliance having a drum which is mounted in a rotatable manner to carry out a method for applying a processing composition to laundry, the laundry treatment appliance featuring means for carrying out the steps (a) achieving a predefined residual moisture content in the laundry by the addition of water and performing a first rotation of the drum; and (b) applying a processing composition to the laundry.

The means for carrying out steps (a) and (b) are preferably also means for performing the addition of water in a rinse step and the first rotation of the drum as the water is being pumped away or after the water has been pumped away.

The inventive laundry treatment appliance is preferably water-conducting, in particular a washing machine or washer-dryer, quite particularly preferably a washing machine.

In addition to a drum mounted in a rotatable manner in a tub, an inventive preferred washing machine generally features a wash liquor discharge system disposed on the base of the tub, a drive motor for the drum and a heating facility.

A laundry treatment appliance with a drum (e.g. a washing machine) generally features switching means for rotating and stopping the drum. An inventive washing machine preferably further features a pressure sensor for determining a quantity of liquid contained in the tub by way of a measured hydrostatic pressure.

The laundry treatment appliance preferably contains an introduction apparatus for introducing a processing composition into the drum and onto the laundry. It is also preferable for the introduction apparatus for introducing a processing composition to be able to be switched independently of the drum.

The second rotation of the drum in step (c) in the manner described above, as provided for in the inventive method according to a preferred embodiment, allows better distribution of the processing composition to be achieved over the laundry. Distribution can be improved if in a further preferred embodiment the laundry treatment appliance has an additional structural feature for assisting distribution of the processing composition in the laundry. This structural feature is in particular an agitator, which is optimized in respect of the distribution of the processing composition in the laundry. A number or plurality of such agitators, in particular three or four in number, is further preferred.

The abovementioned agitator can be molded into the drum as an integral part or can be inserted into the drum as an additional component. It is also representative of a plurality of embodiments of the structural feature, which is also conceivable as an arrangement of separate ribs or as a helically wound configuration of an inner part of the drum.

According to the invention it is preferable for the introduction apparatus for introducing the processing composition to be regulatable. The introduction apparatus for introducing the processing composition into laundry can preferably be regulated by a corresponding regulating system, which in particular comprises a control facility of the laundry treatment appliance (e.g. a washing machine). It is therefore possible to regulate the introduction of processing composition into the wash liquor. As well as the possibility of a constant introduction of processing composition, which can simply be switched on and off, provision can also be made here for a continuous or gradual variation of the quantity of processing composition introduced.

In the inventive laundry treatment appliance a control facility with an assigned program controller preferably regulates the introduction of the processing composition into the drum in an appropriate manner and quantity. For the careful and restrained dosing of the processing composition it is advantageous in some instances if the processing composition is sprayed into the drum at intervals. In some circumstances indeed it is not possible to keep the quantity of processing composition flowing through a pump used for transportation per unit of time as small as would be necessary for the small total quantity of processing composition required. Since the surface of the laundry to be treated may be large and the distribution of the processing composition then takes longer, it must be possible to select the smallest throughflow quantity per unit of time for the careful introduction of the processing composition and its retaining action. For this reason feeding in the processing composition at intervals appears extremely suitable. It should still be possible to vary this feeding in for laundry items of different sizes and various other process parameters (e.g. different temperature levels, different degrees of premoistening of the laundry items and different types of textile). Where the ability to measure process parameters permits, automatic adjustment of the fed in quantity or feed speed is also possible.

To assist the control facility with the control of the application of the processing composition or the control of the introduction apparatus for the processing composition in a preferred embodiment a suitable sensor is present to determine the type and/or quantity of processing composition in the drum. A suitable sensor may be for example an optical sensor, a conductivity sensor or a tensiometer. This sensor can feed the measured signals to the control facility for further processing by way of a signal line.

The introduction apparatus preferably employed in the inventive laundry treatment appliance is particularly preferably configured by using a nozzle as an atomizing apparatus. The introduction apparatus also generally comprises a container for the processing composition. The container can preferably be refilled and can therefore preferably be removed or detached from the introduction apparatus. Such an introduction apparatus configured as an atomization apparatus also preferably features a dosing facility, which can be used to control the discharge of the processing composition. This is particularly advantageous as the processing compositions may be expensive substances which are to be used as sparingly as possible.

The introduction apparatus can be integrated in the inventive laundry treatment appliance, e.g. within it, or be disposed outside or partially outside it. It is preferably secured in a detachable manner or has at least one detachably secured container.

In a first preferred embodiment the introduction apparatus is disposed in its entirety in the interior of the inventive laundry treatment appliance. The region of the door opening or door is particularly suited for this purpose, as these are regions that have to be accessible to the user, which ensures that the user can insert the introduction apparatus and fill the container. However the introduction apparatus can also be located in the region of the rear wall of the drum, being configured as cylindrical or wedge-shaped in the center.

In a second preferred embodiment the introduction apparatus is disposed on the outside of the housing, preferably on the door or on a porthole of the inventive laundry treatment appliance. For a discharge facility configured as a nozzle to be connected to the drum, an opening is generally provided in the housing at the corresponding point in the inventive laundry treatment appliance, being provided with the necessary sealing means and through which the discharge facility can be passed. This arrangement is particularly advantageous as it allows the container of the introduction apparatus to be filled easily. This arrangement is also very advantageous for a further embodiment, in which the processing composition is provided ready for use in an atomizing apparatus, for example in the form of a spray nozzle, and then only has to be secured to a corresponding point on the door of the laundry treatment appliance, in some instances with its own holding means.

It is also possible to provide a separate door element, e.g. as an accessory, which already comprises an introduction apparatus or atomizing apparatus and can simply be fitted in place of the existing door. This allows the user simply to switch their laundry treatment appliance from normal operation to processing operation. In a further preferred embodiment, which can also be combined with those mentioned above and further embodiments, the container of the introduction apparatus or atomizing apparatus is disposed outside the housing of the inventive apparatus and is connected by way of a line, e.g. a hose, to the discharge facility (e.g. nozzle) in the interior. This has the advantage that it allows the container to be filled in the simplest manner. A hose connection between the container and the discharge facility is also possible for other embodiments.

The discharge facility (e.g. nozzle) should be connected to the drum. It is therefore also preferably disposed in the region of the door or door opening. However it can also be disposed in the region of the rear wall of the drum.

The discharge facility (nozzle) is preferably located in the upper region of the treatment compartment. A spray mist generated by it can then be distributed as effectively as possible and over the entire surface of the drum wall, which is below the discharge facility. In one preferred embodiment the discharge facility is disposed in the region of the seal that seals the tub. The discharge facility is preferably located in the upper region of the seal and is thus directed into the interior of the drum in such a manner that the spray mist can be distributed flat or conically obliquely downward over the entire depth of the drum. The nozzle is preferably directed obliquely downward. Compressed air or ultrasound technologies or a combination of both can be used to spray the processing composition. In this process the processing composition is either sucked out of the container by way of a venturi nozzle (atomizer principle) or subjected to a higher pressure (e.g. spray can) by the air flow or gas flow. The container may already be under pressure or it may be connected to an additional pressure vessel (e.g. a gas cartridge containing carbon dioxide or the like) and a mixing nozzle (e.g. a venturi nozzle). When a valve, preferably a solenoid valve, is opened, the exiting gas flow carries the processing composition with it. This can be effected for example using a venture nozzle. Suitable compressed air generation is required for compressed air atomization. A suitable diaphragm pump can also be used in addition to a compressor with a compressed air storage unit.

According to the invention the inventively preferred spraying of the processing substances preferably takes place in a first substep (c1) at or above the speed at which the laundry lies against the drum. Surprisingly it has proven that spraying processing substances onto a ring of laundry rather than onto laundry moved by a rotating drum produces a much more even result, in particular when the spray phases at a minimum of the speed at which the laundry lies against the drum alternate with phases of reversing at a lower speed (below the speed at which the laundry lies against the drum) in a second substep (c2), with the processing composition again only being discharged while the drum is moving at the speed at which the laundry lies against the drum or faster.

In a second substep (c2) the drum is preferably moved at a speed below the speed at which the laundry lies against the drum, preferably at a speed between 35 and 65 rpm, preferably 45 to 55 rpm. Periodic reversing with pauses is recommended here. For example 5 to 20 seconds in one direction, pause of 1 to 5 seconds, 5 to 20 seconds in the other direction. This is expediently repeated once or twice or more often. This step ensures that the laundry to be processed is redistributed. It also allows the processing composition to be better distributed in the laundry, moistening it evenly without staining. The two steps can likewise be repeated. A processing period of 20 to 120 minutes, in particular 30 to 110 minutes, preferably 40 to 100 minutes and more preferably 50 to 90 minutes in total is advantageous.

500 to 2000 ml of liquid are expediently sprayed on with this method. However the quantity is a function of the type of processing composition and also the quantity of laundry to be processed. In the case of cyclodextrins and microcapsules 700 to 1000 ml are advantageous. The laundry should preferably be moistened to a level of 30% to 70% of its dry weight.

When the laundry is brought into contact with a processing composition comprising microcapsules and/or cyclodextrins by spraying, it is expedient to fix the processing substances on the laundry immediately after spraying.

It can also be expedient, after the processing substances have been brought into contact with the laundry, to provide for an action time, during which the laundry can absorb the processing composition completely, to ensure the most even distribution possible of the processing substances on the laundry. The action time can easily be determined by the person skilled in the art.

After the processing composition has been brought into contact with the laundry, in one possible embodiment said laundry can be subjected to an operation similar to a normal washing operation. In other words an action time is preferably provided in which the laundry completely absorbs a wash liquor that consists of water and the processing composition and can also in some instances contain further additional substances and active agents. The drum is preferably moved during this time, as is normal with a conventional washing operation.

In a further preferred embodiment the processing composition is fixed after being applied to the laundry. In this way, after the laundry has been brought into contact with the processing composition, microcapsules and/or cyclodextrins that may be present in the processing composition are preferably fixed to the laundry. This is preferably achieved by means of a heat treatment or a chemical treatment.

When a heat treatment is used, drying using a washer-dryer is particularly suitable. It is particularly preferable for this to be performed in the same drum. The use of a washer-dryer is therefore particularly preferred.

The heat treatment preferably comprises a treatment at a temperature between 80 and 150° C., preferably 90 to 140° C., preferably 100 to 120° C., particularly preferably 130° C. These temperatures can already be attained in conventional dryers and washer-dryers. It is recommended to provide a separate point for such a heat treatment step in the menu or on the control panel (for example Fixing 130° C.). Fixing can also take place at higher temperatures, e.g. up to 180° C., in particular 150° C. to 170° C., as long as the laundry treatment appliance is designed for such temperatures. Drying should preferably be performed in a reversing manner to ensure even temperatures in the laundry. When the entire method is applied in a washer-dryer fixing can also take place in the same appliance. The drying time depends on the type and quantity of the laundry. Efforts should be made to achieve the most complete drying possible.

It is also possible to fix the processing substances chemically. Immediately after fixing, if necessary, excess processing composition is removed, optionally by one or more rinses and/or by spinning.

This spinning step is preferably also performed after fixing, in particular of the cyclodextrins. All conventional spinning methods are suitable for this purpose.

It may also be expedient to remove excess processing composition after the contact operation and before fixing. Spinning can be applied here.

The dryer function of an optionally used washer-dryer is suitable for the step of fixing the processing substances. To this end a special program is provided which can preferably run after a normal washing operation but also independently thereof. Separate appliances can also be used, e.g. first a washing machine for processing and then a dryer for fixing the processing substances on the laundry.

One advantage of the inventive method is that it is generally not necessary to spin off excess processing compound, as it has generally been applied in a minimum quantity tailored to the small amount of residual moisture in the laundry.

In one extension of the inventive method not only is the laundry provided with the processing composition but the processing composition in turn is loaded with active agents, for example a fragrance, cosmetics and the like. Cyclodextrins are particularly suitable for such loading, as they are able to accommodate molecules in their hollow structure.

It can be advantageous in some embodiments to subject the laundry to a pretreatment step before applying the processing composition. The pretreatment step preferably comprises a chemical activation of the surface of the laundry.

When processing laundry with cyclodextrins it is particularly preferable for the laundry to be activated before the processing composition is added. In the case of cotton materials to be processed with cyclodextrins, this pretreatment step is a treatment with an alkaline medium such as a strong alkaline soda solution or the like. In this instance the alkaline solution should essentially be removed in a spin step before the processing composition is added. An alkaline solution for activating the laundry is preferably a soda solution. Soda solutions of between 0.1 and 5% by weight are suitable. In the case of an approx. 2% soda solution the pH value is around 10-11. A pH range of 8 to 12 is preferred, in particular 9 to 11, in particular 10. Other alkaline means can also be used, e.g. caustic soda. The person skilled in the art is able to select a suitable alkaline solution and determine the appropriate pH value. These parameters are a function of the laundry to be processed. Activation of the laundry allows covalent bonding, in particular of the cyclodextrins to the laundry.

When the cyclodextrins have discharged their content they can be reloaded with new substances. This can be done in different ways, for example by spraying with the relevant substance, e.g. a fragrance. A spray apparatus can also preferably be used here, being connected to the inventive laundry treatment appliance or integrated in it.

The inventive method and the inventive laundry treatment appliance have clear advantages. One advantage of the invention is that it avoids losses of processing substances and environmental pollution by waste water containing processing substances. Batch methods in a washing machine would result in processing substance losses of more than 50%. This figure is much lower with the present invention. There is a clear improvement in the eco-balance for all forms of textile processing. There is also a more even distribution of textile processing (processing composition) over the processed laundry. The invention allows a better degree of extraction and at the same time greater evenness to be achieved than with a simple spraying method. Also the inventive method is not necessarily associated with additional costs in the laundry treatment appliance.

A further advantage of the inventive method is also the initial processing of items of clothing, in contrast to panels of material, in particular of conventional ready-made clothing or the reprocessing of such ready-made clothing when the processing substances have been used up.

Surprisingly it has been proven that it is also possible to provide laundry, in particular textiles, with special processing substances in a household washing machine, a household dryer or a household washer-dryer. The inventive method makes it possible to apply even small quantities of processing compositions to laundry to be processed with little loss. This is true in particular of cyclodextrins and microcapsules which are very expensive and should not be mixed into a wash liquor due to the significant loss during rinsing.

BRIEF DESCRIPTION OF THE DRAWINGS

The invention is illustrated in more detail below based on the exemplary embodiments, which do not restrict the invention, as shown in FIGS. 1 to 3, in which.

DETAILED DESCRIPTION OF EXEMPLARY EMBODIMENTS OF THE PRESENT INVENTION

Figure 1:
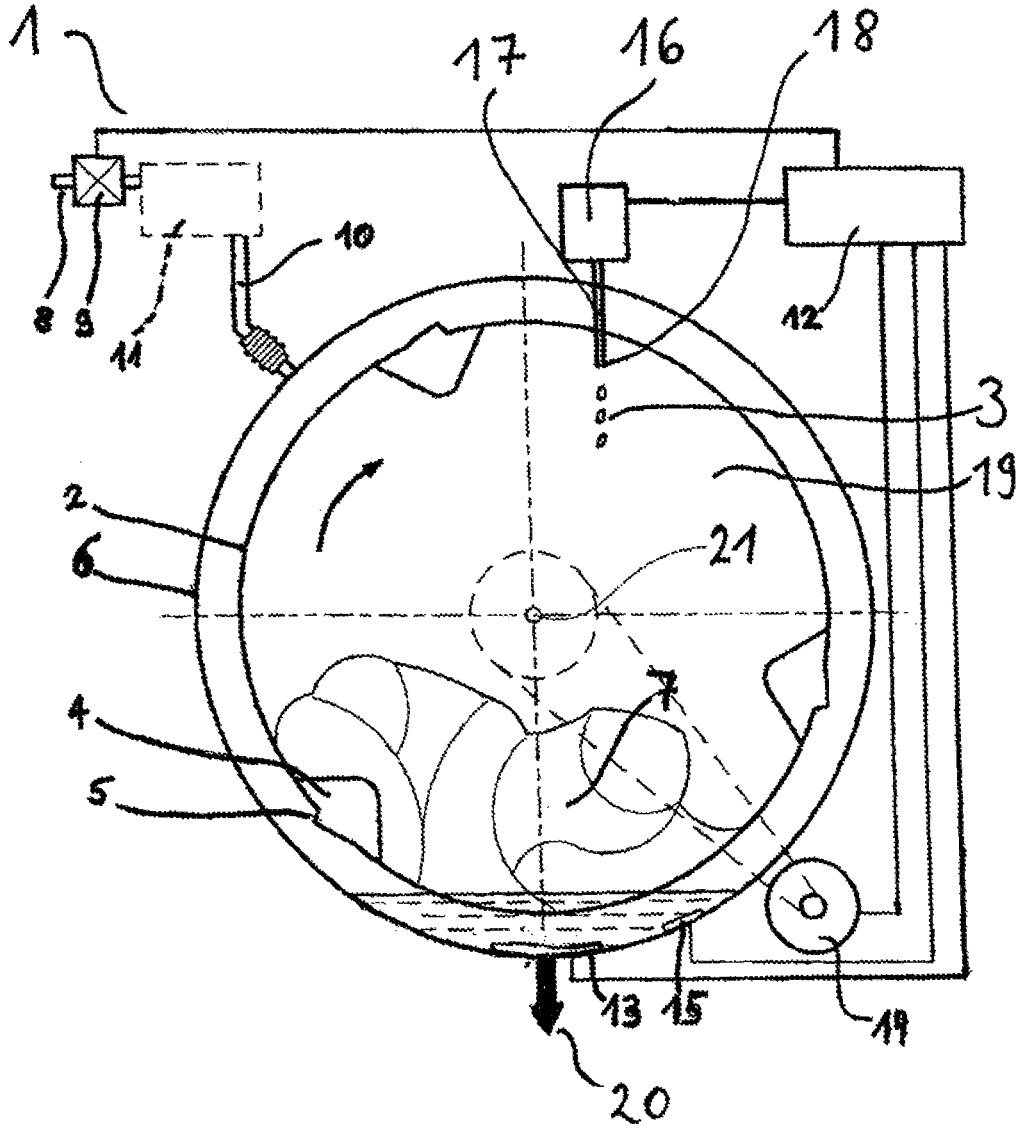
FIG. 1 is a schematic diagram of the parts of an inventive laundry treatment appliance of relevance to the illustration, said laundry treatment appliance here being configured as a washing machine, in which an inventive method can be carried out. Other embodiments are also possible.

The washing machine of the embodiment illustrated in FIG. 1 has a tub 6, in which a drum 2 is mounted in a rotatable manner and can be operated by a drive motor 14. The axis of rotation 21 of the drum 2 is directed upward and forward through a small angle (e.g. 13°) away from the horizontal to allow easier access to and viewing of the interior of the drum 2. This arrangement together with specially shaped agitators 4 and scooping facilities 5 for the wash liquor 6 on the inner surface of the drum also allows a more intensive flow of wash liquor or water through the laundry 7 to be achieved and better distribution of the processing composition 3 in the step in which the processing composition 3 is applied.

The washing machine 1 also has a wash liquor inlet system, comprising a water connection fitting for the domestic water network 8, an electrically controlled valve 9 and a supply line 10 to the tub 6, which can optionally also pass by way of a detergent dispensing facility (dispenser tray) 11, from which the incoming water can transport portions of detergent into the tub 6. A heating facility 13 is also present in the tub 6. The valve 9 and the heating facility 13 are controlled by a control facility (program controller) 12 as a function of a program sequence plan, which is linked to a time program and/or the attainment of certain measured values of parameters such as wash liquor level, wash liquor temperature, speed of drum 2, addition of rinse water, pumping away of wash liquor or rinse water, added quantity of processing composition 3, etc. within the washing machine 1.

A wash liquor discharge system 20, which conventionally comprises a discharge valve and drain pump as well as corresponding lines, is only shown schematically for purposes of clarity.

The introduction apparatus 16, i.e. the apparatus for introducing processing composition 3 into the drum 2 and onto the laundry 7 therein, is shown in the embodiment in FIG. 1 in combination with an injection apparatus 17, the output (e.g. nozzle) 18 of which projects into an upper region 19 of the drum 2 in the embodiment shown in FIG. 1.

The agitators 4 are additional structural features of the drum 2 optimized to assist the distribution of the processing composition 3 in the laundry 7.

The distribution of processing composition 3 is regulated by way of a regulating system comprising a sensor 15 for determining the processing composition 3 and the control facility 12, so that the quantity of processing composition 3 available for treating the laundry 7 is controlled and in particular also limited either by switching the introduction apparatus 16 on and off in an alternating manner or by varying the output.

The introduction apparatus 16 can transport the processing composition, which is present as an aqueous solution, in the form of a jet of liquid, individual drops or in the form of very small droplets, into the drum 2 and onto the laundry 7.

Figure 2:
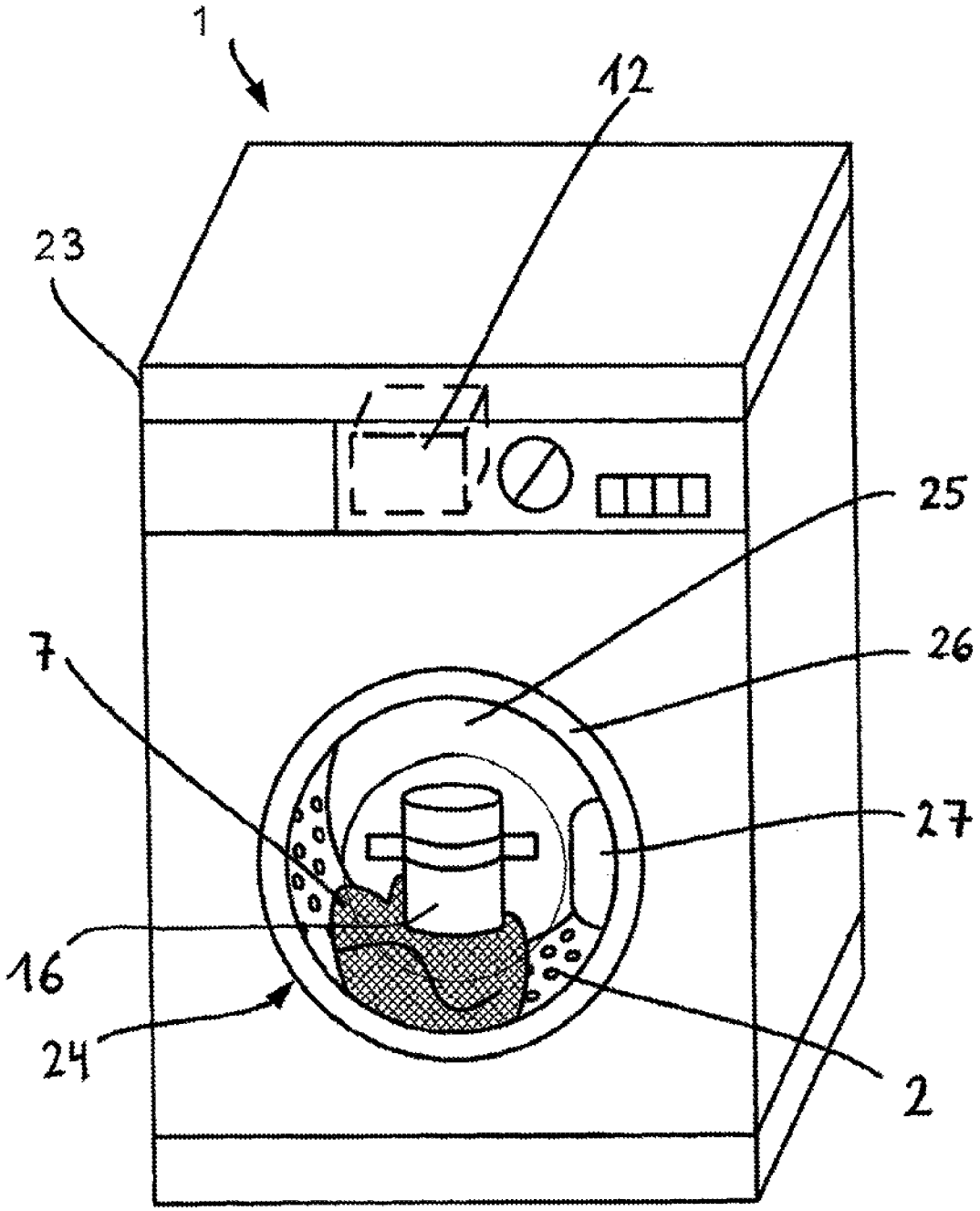
FIG. 2 shows a schematic top view of an inventive laundry treatment appliance, also configured as a washing machine here.

FIG. 2 shows a washing machine 1 with a housing 23 and a drum 2, in which laundry 7 is present. In the view shown the door 24 can be seen in the top view, consisting, as is usual for washing machines, of a transparent concave door 25. The door 24 is provided with a sealing ring 26 and a handle 27. A control unit 12 present in the interior of the washing machine is also shown in the drawing. An introduction apparatus 16 is present in the region of the door 24.

Figure 3:
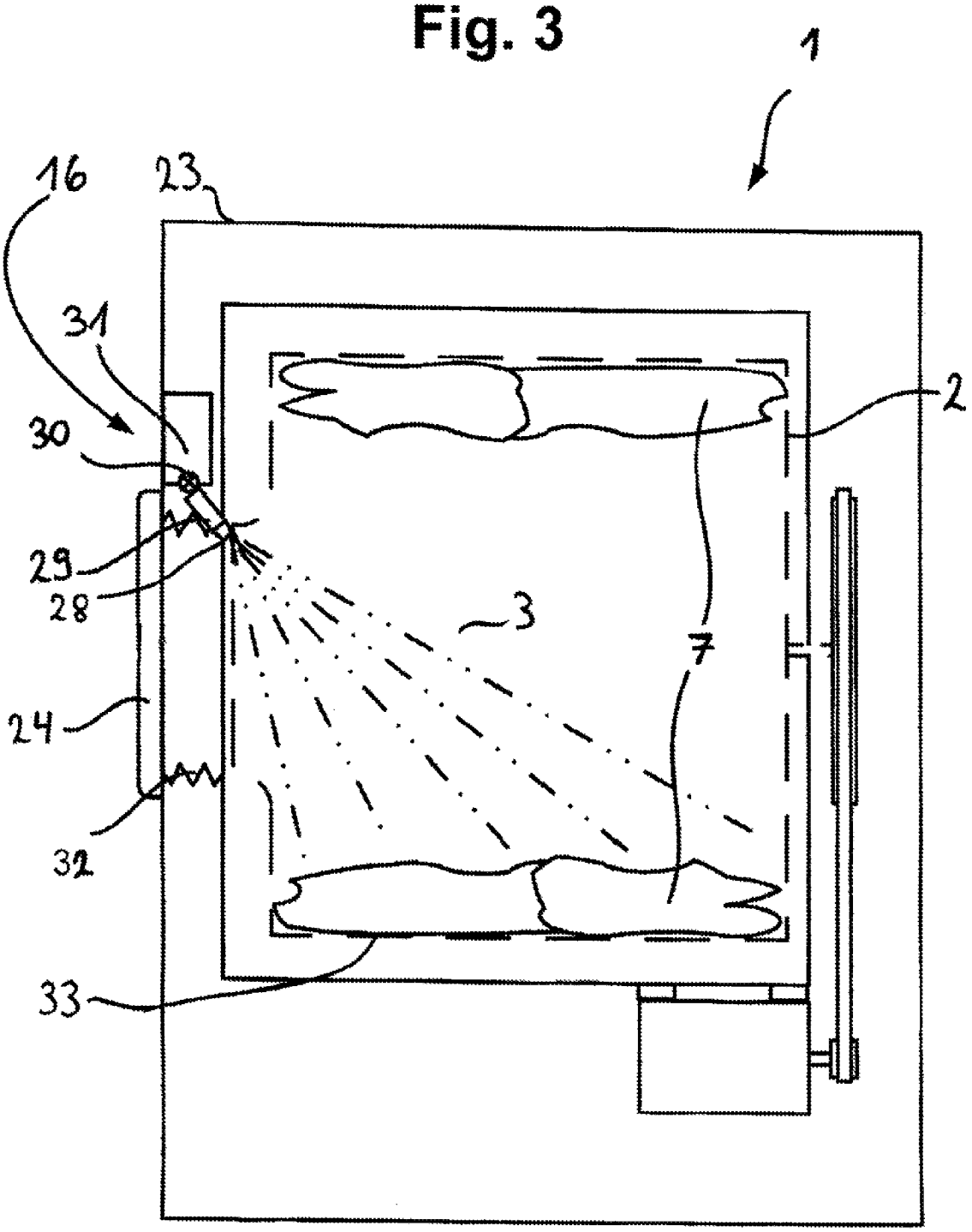
FIG. 3 shows a sectional side view of an inventive laundry treatment appliance, configured here as a washer-dryer.

FIG. 3 shows a sectional side view of an inventive washer-dryer 1.

The washer-dryer 1 has a housing 23 and a drum 2, in which laundry 7 is present. The drum 2 is rotated at a speed such that the laundry 7 lies against the drum wall 33 in the manner of a ring of laundry 7. The washer-dryer 1 is closed by a door 24 at one side and has an introduction apparatus 16 in the form of an integrated atomization apparatus. Door 24 has an opening 28, through which a nozzle 29 projects into the drum 2. Inside the housing 23 but outside the drum 2 are a dosing facility 30 and a container 31 for the processing composition 3. In this embodiment the introduction apparatus 16 is passed through the seal 32 and projects partially into the drum 2. A spray is emitted to distribute the processing composition 3 evenly over the ring of laundry 7.

The invention claimed is:

1. A method for applying a processing composition to laundry in a laundry treatment appliance having a drum that is rotatably mounted, the method comprising:

setting a predefined residual moisture content in the laundry by adding water and by a first rotation of the drum;

applying a processing composition to the laundry in one of liquid form and in the form of fine droplets at a time after the first rotation of the drum;

fixing the processing composition to the laundry;

wherein the processing composition is sprayed onto the laundry by an introduction apparatus while the drum is rotated at least at a speed at which the laundry is forced against the drum due to centrifugal forces; and wherein the processing composition is not a detergent.

2. The method of claim 1, wherein the water is added in a rinse step and wherein the first rotation of the drum takes place as one of the water is being pumped away and after the water has been pumped away.

3. The method of claim 1, wherein the predefined residual moisture content is set by the first rotation of the drum at the speed at which the laundry lies against the drum.

4. The method of claim 1, wherein the first rotation of the drum is performed at one of equal to or greater than 100 revolutions per minute.

5. The method of claim 4, wherein the first rotation of the drum is performed at between 100 revolutions per minute to 150 revolutions per minute.

6. The method of claim 4, wherein the first rotation of the drum is performed at at least 230 revolutions per minute.

7. The method of claim 1, wherein the processing composition is distributed in the laundry by a second rotation of the drum.

8. The method of claim 7, wherein the second rotation of the drum is performed at equal to or greater than 100 revolutions per minute.

9. The method of claim 1, wherein, in order to apply the processing composition to the laundry, the drum is moved in a first substep at least at the speed at which the laundry lies against the drum and, in a second substep, at a reverse mode speed in a reverse mode that is lower than the speed at which the laundry lies against the drum; and wherein the processing composition is only discharged by the introduction apparatus when the drum is moved at one of the speed at which the laundry lies against the drum and faster than the speed at which the laundry against the drum.

10. The method of claim 1, wherein the processing composition is fixed after being applied to the laundry.

11. The method of claim 1, wherein the laundry is subjected to a pretreatment step before applying the processing composition to the laundry.

12. The method of claim 11, wherein the pretreatment step is a chemical activation of a surface of the laundry.

13. The method of claim 1, wherein the processing composition is bonded to the surface of the laundry, or the processing composition is introduced between fibers of the laundry, or the processing composition is bonded to the surface of the laundry and introduced between the fibers of the laundry.

14. The method of claim 1, further comprising a washing phase in which the laundry is cleaned with the aid of laundry detergent, the washing phase occurring prior to the first rotation of the drum.

15. The method of claim 1, wherein the processing composition comprises an impregnating agent, a dye, a starch, a cyclodextrin or a microcapsule.

16. The method of claim 1, wherein the processing composition is fixed with a heat treatment or a chemical treatment after the drum is rotated at the speed at which the laundry is forced against the drum due to centrifugal forces.

17. The method of claim 1, further comprising chemically activating a surface of the laundry prior to applying the processing composition.

* * * * *